United States Patent [19]

Belongia

[11] Patent Number: 4,553,461

[45] Date of Patent: Nov. 19, 1985

[54] ROTARY WEB PROCESSING APPARATUS

[75] Inventor: Larry P. Belongia, Oconto, Wis.

[73] Assignee: Magna-Graphics Corporation, Oconto Falls, Wis.

[21] Appl. No.: 433,651

[22] Filed: Oct. 12, 1982

[51] Int. Cl.[4] ..... B26D 1/56

[52] U.S. Cl. ..... 83/344; 83/346; 83/348; 83/342

[58] Field of Search ..... 83/344, 346, 348, 343, 83/342

[56] References Cited

U.S. PATENT DOCUMENTS

| | | | |
|---|---|---|---|
| 238,522 | 3/1881 | Page | 83/346 X |
| 2,850,092 | 9/1958 | Teplitz | 83/344 X |
| 3,448,684 | 6/1969 | Cardinet et al. | 83/344 X |
| 3,826,165 | 7/1974 | Currie et al. | 83/342 X |
| 4,205,596 | 6/1980 | Chesnut | 83/344 X |
| 4,413,541 | 11/1983 | Biggar, III | 83/346 |

FOREIGN PATENT DOCUMENTS

| | | | |
|---|---|---|---|
| 2254281 | 5/1974 | Fed. Rep. of Germany | 83/344 |

*Primary Examiner*—Donald R. Schran

*Attorney, Agent, or Firm*—Andrus, Sceales, Starke & Sawall

[57] ABSTRACT

A rotary die cutter includes a frame having spaced side plates. An anvil roll and a die plate roll are rotatably supported in bearing housings which are mounted in vertical slots in the side plates. A roll gap adjustment unit includes a lead screw and a follower member fixedly attached to the anvil bearing housing. The lead screw is threaded into said follower and projects upwardly. A thrust bearing is mounted on the sprocket and the upper bearing housing rests on the thrust bearing. An actuator is mounted to the side frame and a chain and sprocket couples it to the gap sprocket. The actuator includes a gear reduction drive means having a rotating input dial and an output coupled to the actuator sprocket to rotate the chain and sprocket at the rate of substantially one revolution for each one hundred revolutions of the input dial. Cam roller units engage the outer bottom ends of the anvil roll. Spring-loaded preload cam roller units engage the opposite top ends of the die cut roll. Each roller assembly includes a pair of cam rollers mounted in a yoke and engaging the surface of the roll. The preload cam roller units include an adjustment screw threaded through a load plate and bearing on the backside of the yoke. A pair of bolts pass through the load plate and thread into the frame. Springs act between the bolt heads and the plate to load the die roll and thereby both the die and anvil rolls downwardly and thereby eliminate the effect of bearing clearance in the operation of the rolls.

10 Claims, 7 Drawing Figures

ROTARY WEB PROCESSING APPARATUS

BACKGROUND OF THE PRESENT INVENTION

This invention relates to rotary web processing apparatus and particularly to a rotary die cutter apparatus for die cutting, perforating, embossing and otherwise surface shaping and working of a web material.

In the production of paper and film products, a continuous web of material is passed through in-line apparatus to shape, cut and otherwise operate on the material to form a product. In the processing, a rotary die cutter apparatus may be used for proper die cutting, perforating and creasing of the web material. The die cutter apparatus may consist of a smooth, hard finished anvil roll or cylinder and an opposed die cut roll or cylinder having a cutting, perforating, creasing or other working plate or member on the surface. The surface speed of the rolls and of the web material are matched to permit continuous on-line processing of the web as it moves through the rolls. In such systems, the axis parallelism and a constant gap or spacing between the rolls must be accurately set and maintained in order to maintain the proper relationship between the working members and the anvil roll for accurate and repeatable formation of the same cut or groove on the web.

Further, in high speed web processing apparatus using opposed working cylinders, great care must be taken to avoid cylinder bounce during working of the web material. Thus, the cylinders are generally gear driven at high speed. With a gap between the cylinder, there is a tendency for the cylinders to move with a slight bounce. Any such "bounce" movement of course provides an undesirable variation in the gap, and may damage the equipment and/or the work.

In many applications, die cutting apparatus uses relatively small diameter cylinders, such as ten inches in diameter. The supporting bearing structures for such rollers generally provide for various forms of gap adjusting mechanisms. Further, with relatively high speed and small diameter cylinders, relatively fine adjustment of the positioning or setting of the gap is often necessary or desired.

The prior art encountered in the prosecution of the application entitled "Adjustable Mounting For Cooperating Die Cylinders" which was filed on Sept. 29, 1980, discloses various prior art approaches to cylinder roll adjustment. For example, U.S. Pat. No. 1,289,084 discloses an adjustable lock nut arrangement for spreading the radial bearings of the unit and thereby adjusting the positioning of the cylinders. U.S. Pat. No. 4,130,042 discloses a special bearing structure including a resilient deflectable inner annular member mounted as an eccentric and a pivot arm for turning the members and pressure loading of the cylinder bearings to vary the gap.

Not withstanding the many different suggestions which have been made in the prior art, there is a need for a simple, reliable and practical construction of a gap adjustment means which can be located within the limited space available with small diameter cylinders and which includes means permitting fine adjustment by the operator, and preferably without the necessity of any particular actuation tools.

The operator or maintenance personnel can then adjust the gap with only the use of suitable gap measuring instruments to any desired requirement. The setting of course not only is dependent upon the accuracy of this setting and the tolerances within the adjusting apparatus, but also upon the technical skill and ability of the personnel making the adjustment.

SUMMARY OF THE PRESENT INVENTION

The present invention is particularly directed to an improved gap adjustment means for the rolls or cylinders of rotary web processing apparatus and to an improved preloading of the roll or cylinder bearings of the apparatus, such as die cutting and other similar apparatus and is particularly applicable to such apparatus including relatively light weight, small diameter processing cylinders or rolls which are devices at relatively high speed. Generally in accordance with the present invention, gap adjustment means having a rotating input is interposed between the bearing structures of the cylinders, and in relatively small machines includes a coupling such as a sprocket, pulley, chain drive or the like to an external or remote actuator which includes a motion reduction mechanism, such as a gear reduction means. The motor reduction mechanism establishes a substantial reduction ratio such that the actuation of the external control results in a small change in the internal gap adjustment means such as to permit setting of the gap to an accuracy of tenth of thousands (0.0001) of an inch and preferably with an essentially infinite adjustment over a given practical range. The roll is preloaded by a resilient means which urges the one roll toward the opposite roll which is relatively fixed to load the bearings and the adjustment means and maintain a stable operation with the adjusted gap held during the high speed processing of the web.

More particularly, in a unique and practical embodiment of the present invention, the gap adjusting unit includes a fine thread lead screw adjusting unit having the lead screw member rotatably mounted in a follower nut number, with one member secured to the bearing unit of one roll and the second member being driven to adjust the length of the unit. A thrust bearing couples the second member to the bearing unit of the other roll. A rotating coupling is coupled by an elongated endless band member to an external rotating output of a gear reducer. In one practical embodiment, the follower nut is rigidly affixed to and forms an integrated part of the bearing housing which supports the cylinder bearing means. The lead screw is rotatably mounted in the follower and a fixed bearing support. A sprocket is affixed to the lead screw and coupled by a chain to the remote actuator. A thrust bearing rests on the lead screw sprocket and the bearing for the die cut roll is supported on the thrust bearing. The remote actuator includes a gear reducer specially selected with a reduction on the order of 100 to 1. Each complete revolution of the reducer input results in a 1/100th rotation of the output and a corresponding rotation of the lead screw. The gear reducer includes a calibrated input dial which permits fine adjustment of the gap without the necessity of special actuating tools.

The preload means includes a pair of similar cam roller assemblies beneath the opposite ends of the lower roll or cylinder to provide a firm rotatable support. A pair of resiliently loaded cam roller assemblies are mounted above the top roll of cylinder and include cam rollers engaging the cylinder which are resiliently loaded and urge the top cylinder toward the lower cylinder, and thereby load the bearing in the one direction, and thereby avoid movement because of bearing clearance, including the original inherent clearance and wear or the like.

The present invention has been found to provide a simple and reliable implementation of an essentially infinitely variable gap adjustment for die cutting and similar web processing apparatus.

DESCRIPTION OF THE DRAWING FIGURES

The drawings furnished herewith illustrate a preferred construction of the present invention in which the above advantages and features are clearly disclosed as well as others which will be readily understood form the following description.

DESCRIPTION OF THE ILLUSTRATED EMBODIMENT

Figure 1:
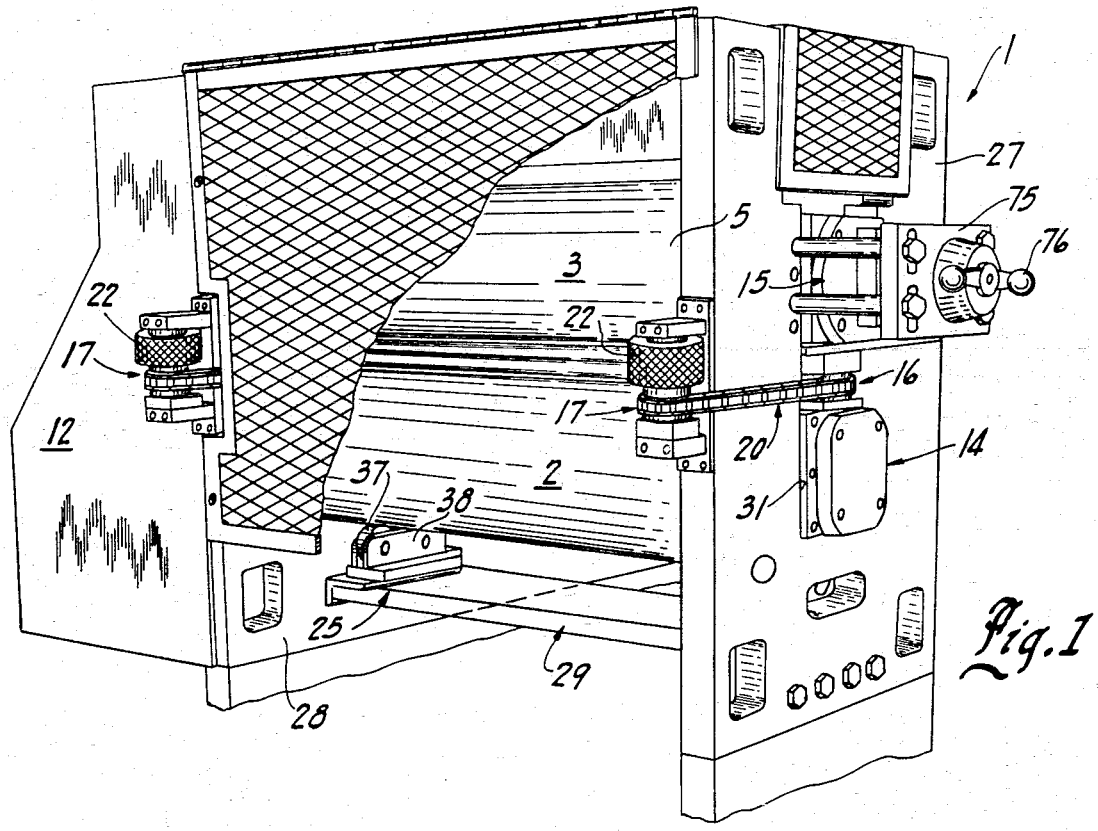
FIG. 1 is a pictorial view of a die cutting apparatus with parts broken away to illustrate certain detail of the embodiment of the present invention.
Figure 2:
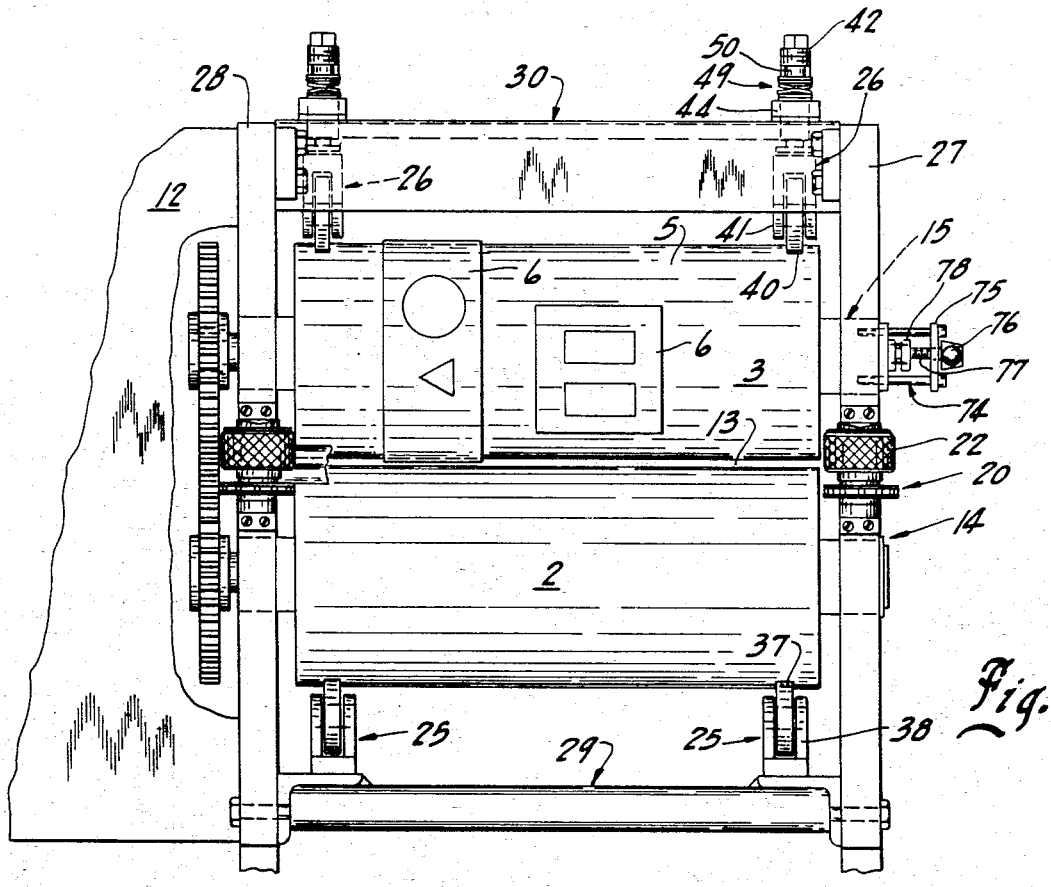
FIG. 2 is an enlarged front view of the apparatus shown in FIG. 1.
Figure 3:
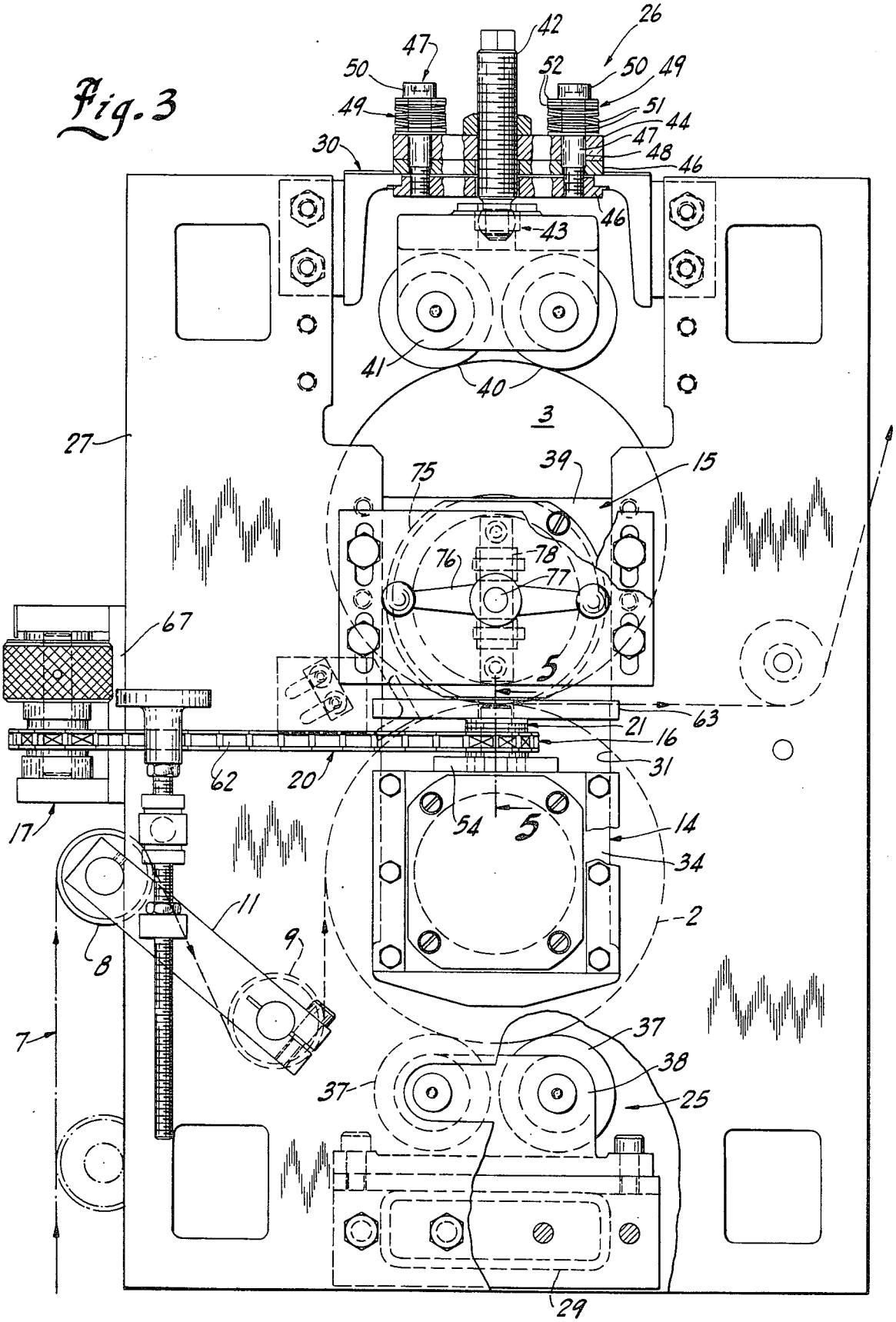
FIG. 3 is an enlarged vertical side view of the apparatus shown in FIGS. 1 and 2 and more clearly illustrating the structure of the present invention.

Referring to the drawings and particularly to FIG. 1, a die cutting apparatus 1 is illustrated including an anvil roll 2 and an opposed die cut roll 3 rotatably mounted within a supporting frame structure 4. The die roll 3 includes a cylinder 5 with a web working plate unit 6 such as a die cutter, a perforator or the like, secured to the surface. As shown in phantom in FIG. 3, a film-like web 7 is passed between the die roll 3 and the anvil roll 2 and is worked by the plate unit 6. A pair of entry guide rolls 8 and 9 are located to the entry side of the rolls 2 and 3, as shown in FIG. 3. An exit roll 10 is mounted to the back side of the rolls 2 and 3. The web 7 is passed over the entry roll 8, between the anvil roll 2 and die plate roll 3, and then discharged over the exit roll 10. The entry roll 8 is shown pivotally mounted on an arm 11, with one to each end of the frame structure for positioning in a by-pass location below roll 2 to permit by-pass of web 7. The die roll 3 and the anvil roll 2 are positively driven by a suitable drive means 12, such as a positive motor-gear drive train, in accordance with well known design. The cylinder 5 of die roll 3 and the anvil roll 2 as well as the drive may be of any suitable construction. Such components are hereinafter described only as necessary to fully discuss and explain the illustrated embodiment of the invention. Generally the anvil roll 2 and die roll 3 are mounted for relative movement for setting and adjusting a working gap 13 therebetween, shown most clearly in FIG. 2 in enlarged illustration for clarity. The gap 13 between the die cut roll 3 and the anvil roll 3 must be precisely set and maintained for proper working of the web 7 by the working edges of the plate member 6. Thus, during initial set up, and during operation, the gap 13 is accurately set by the operator. The opposite ends of anvil roll 2 are rotatably supported within the frame structure 4 by similar bearing units 14. The opposite ends of roll 3 are rotatably supported within the frame structure 4 by similar bearing units 15, located in vertical alignment with the bearing units 14. A gap adjustment unit 16 is located between each of the end bearing of the aligned roll bearings 14 and 15, and includes a remote actuator 17 located to the front of the support 4. The actuator 17 is operable to change the gap unit 16 to vary the spacing of the bearing 14 and 15 and thereby the rolls 2 and 3 for the gap 13 to the desired heighth. The separate gap unit 16 at the opposite ends of the rolls 2 and 3 permit equalizing of the gap 13 across the rolls, which is of course important to properly process the web 7.

The present invention is particularly directed to a gap adjustment apparatus 16 and a roll loading apparatus which is more fully described and shown to illustrate one embodiment of the invention.

Figure 4:
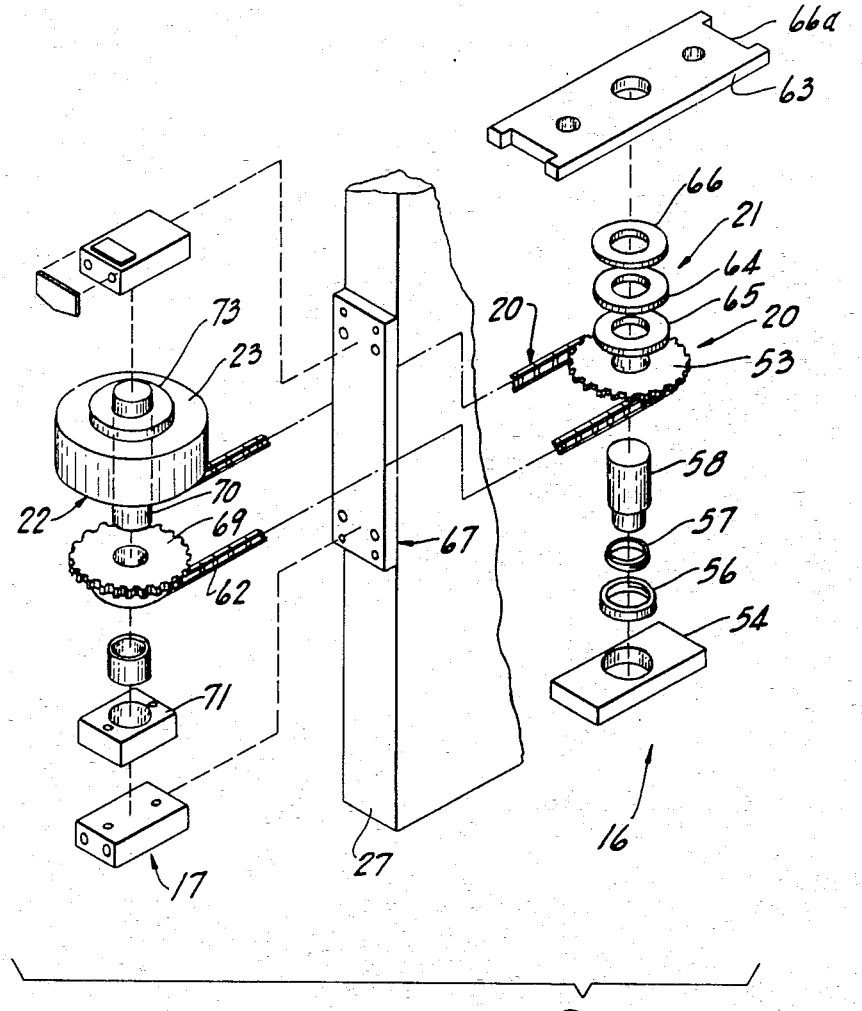
FIG. 4 is an exploded view of the gap adjustment means shown in FIGS. 1–3.
Figure 5:
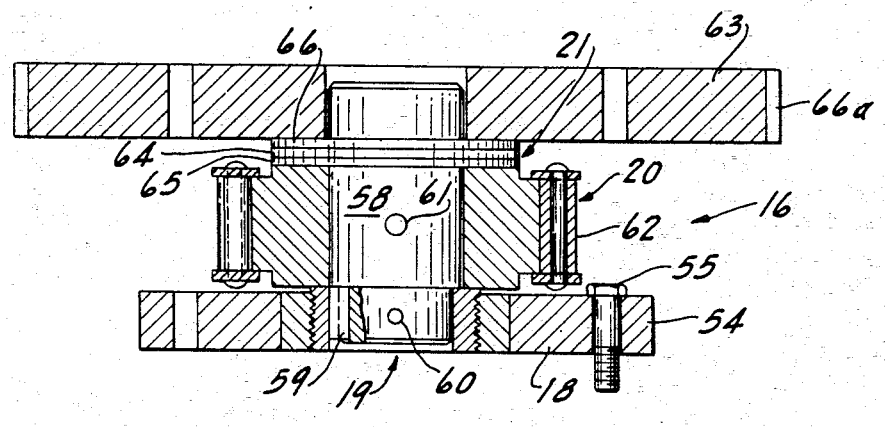
FIG. 5 is a sectional view through the gap adjustment means and taken generally on line 5—5 of FIG. 3.

The gap adjustment unit 16 generally is of a lead screw and follower construction, and is shown most clearly in FIGS. 4 and 5, having a follower unit 18 affixed to the anvil bearing 14. A lead screw unit 19 is threaded into follower unit 18 and projects upwardly toward the die roll bearing unit 15. A chain and sprocket unit 20 is secured to the lead screw unit 19 and supports a thrust bearing unit 21. The bearing unit 15 of the die roll 3 rests on and is supported by the thrust bearing unit 21. The chain and sprocket unit 20 connects the lead screw unit to the actuator 17 for rotation of the lead screw unit 19 and movement into and from the follower unit 18 to adjust the vertical position of the thrust bearing unit 21 and therefore the die roll bearing unit 15. The external, remote actuator 17 includes a rotating input dial 22 which is coupled by a step down or reduction coupling unit 23 to the chain and sprocket unit 20. Rotation of dial 22 permits fine adjustment of the adjustment unit 16 and therefore the setting of the gap 13. The separate adjustment of the opposite end bearing assemblies of course permits setting of a contact gap across the face of the rolls.

The roll the bearing units 14 and 15 are mounted within the frame 4 to permit the relative movement of the bearing units for gap adjustment. The adjusted position is fixed and is maintained by preloading of the rolls 2 and 3 including the bearing units 14 and 15 so as to maintain the gap 13 constant and to eliminate bounce which might be created due to bearing clearance and the like. The preload means includes similar preload assemblies to the opposite ends of the rolls 2 and 3, and each assembly includes a bottom roller support unit 25 and an upper or top spring-loaded roller support unit 26. The upper unit 26 creates a resilient spring force which is applied to the die roll 2 and transmitted to the die roll bearing unit 15, through the gap adjustment unit 16 to the anvil roll bearing unit 14 and to the anvil roll 2 and thus to the bottom roller support unit 25. The spring-loaded support of the rolls 2 and 3 in combination with the special gap adjustment unit 16 produces a die cutting apparatus which significantly minimizes roller deflection and cylinder bounce and maintains an accurate, constant gap 13 between the cylinder and therefore between the working plate 6 and the anvil cylinder 2.

More particularly, the frame structure 4 is a generally rectangular frame unit having heavy supporting side wall plates 27 and 28 which are interconnected by a bottom cross-beam 29 and a top cross-beam 30. The side wall plates 27 and 28 having similar slots 31 extending inwardly from the upper end. The bearing units 14 and 15 are located within the slots 31 in the plates 27 and 28 to support the anvil roll 2 and the die cut roll 3 in vertically spaced and operative relation.

Figure 6:
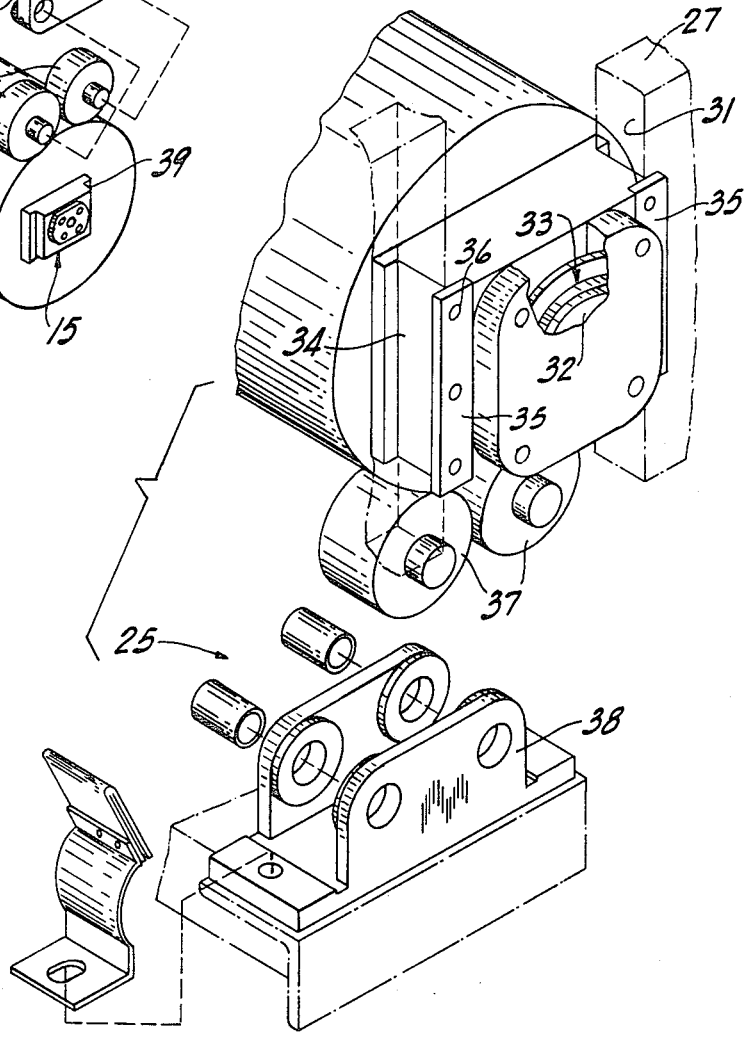
FIG. 6 is an exploded view of a lower cam roller means shown in FIGS. 1–3.

The anvil roll 2 is a hardened steel cylinder 2 with a smooth hard face. The cylinder 2 has opposite end shafts 32 which are similarly rotatably journaled in the bearing unit 14, most clearly shown in FIG. 6, which includes a rotating bearing 33 secured within a box or housing 34. The bearing 33 is any suitable rotary bearing which is adapted to carry the loads and operate at the speeds encountered in die cutting and other web processing. Thus the bearing 33 may include the usual bearing journal, such as an SKF7212 BG (Class 5) with the necessary clearance to permit the rotation. The housing 34 is a heavy, metal rectangular box-like unit with the bearing journal 33 supported therein and is secured within the vertical slot 31 in the side frame plate 27 and supported by a clamp bar 35. The housing 34 is recessed to provide an inner surface abutting the edges of the frame slot 31, as shown. The clamp bar 35 abutts the outer face of the frame plate 27 and is bolted to the housing 34 as by bolts 36.

The anvil roll 2 is vertically supported at the opposite ends by the similar bearings units 25. Each unit 25 includes a pair of cam roller 37 such as a Timken roller bearing rotatably mounted and supported within a U-shaped lower yoke 38. The yoke 38 is bolted to the bottom beam 29 to locate the cam roller 37 engaging the periphery of the cylinder 2 at the bottom side and the outermost end portion and to provide a stable rotatable support for the anvil cylinder 2.

The anvil bearing unit 14 and particularly the upper wall of the housing 34 is an upper flat wall on which the gap adjustment unit 16 is mounted. The upper roller bearing unit 15 is in turn mounted on the adjusting unit 16 and held in predetermined fixed spacing to the lower bearing unit 14 thereby.

Figure 7:
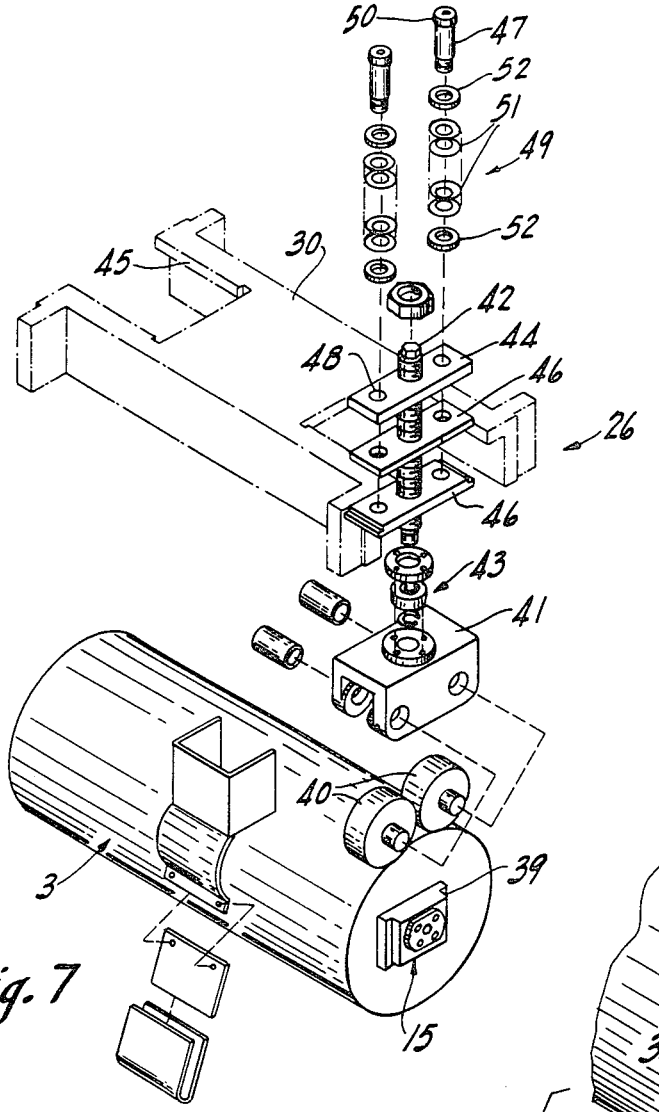
FIG. 7 is an exploded view of the upper preload cam roller means, similar to but to a smaller scale than FIG. 6.

The upper bearing units 15, as shown in FIG. 7, also include a bearing housing 39 located within the slot 31 and having a suitable bearing journal, not shown, within the housing 39 for the shaft of the die cut roll 3.

The die cut roll 3 mounting is loaded on the opposite ends by the spring loaded units 26 in alignment with the lower support units 25 and transmits a downward loading force on the rolls and both the bearing units 14 and 15. The spring-loaded units 26 include a pair of cam rollers 40 rotatably bearing on the upper surface of the die cut roll 3. The cam rollers 40 are mounted in an inverted U-shaped yoke 41. An adjustment screw 42 is coupled to the center of the yoke 41 by a spherical bearing unit 43 and threaded through a support plate 44 mounted to the top beam 30 of the frame structure 4. The beam 30 is formed with an end notch 45 within which the load unit 26 is located. A pair of clamp plates or bars 46 are clamped to the beam, spanning the outer end of the notch 45. The plate 44 is located on the top clamp bar 46 and is held in place by spring loaded clamp shouldered bolts 47 to the opposite sides of the adjusting screw 42.

Each shoulder bolt 47 includes a smooth rod or shaft portion which passes through a guide opening 48 in the adjusting or load plate 44 and the top clamp bar 46 and threads into the lower clamp bar 46. A compression coil spring assembly 49 encircles the shoulder bolt 47 between the bolt head 50 and the load plate 44. The spring assembly 49 includes spring washers 51 mounted in stacked relation with suitable end washers 52. The spring washers 51 are compressed by the tightening of the shoulder bolts 47 and establish the preload force applied to the plate 44 and interconnected adjusting screw 42. The adjustment screw 42 is thus threaded through the plate 44 to preload, in a simple direction, the die cut roll 3 and the anvil roll 2 including the bearing support units 14 and 15. The strength or force is controlled by varying the number of springs and/or washers in the spring stack assembly 49.

The gap adjustment unit 16, which particularly forms a significant improvement, includes the lead screw and follower assembly. The chain and sprocket unit 20 includes a sprocket 53 connected to lead screw unit 19 and operable to vary the length of the vertical support for adjusting the position of the die cut cylinder or roll 3 relative to the anvil roll 2.

More particularly, the follower unit 18 of adjustment unit 16 includes a microspacer block 54, shown as a plate-like member, which is rigidly bolted to the top of the anvil bearing housing 34, as by bolts 55. As shown most clearly in FIGS. 4 and 5, a threaded annular member 56 is fixed within a central opening in the block 54, with the opening axis coincident with the axis of the die cut roll 3 and the anvil roll 2. The lead screw unit 19 includes a microspacer ring 57 threaded into the member 56. The microspacer ring 57 is also pinned to a shouldered shaft 58 which projects upwardly from the block 54. The reduced portion of the shaft 58 is located within and pinned to the ring 57 and secured thereto by key 59 and a lock screw 60. Rotation of the shaft 58 results in the threaded movement of the microspacer ring 57 within the support block 54 with a corresponding axial movement of the shaft 58.

The sprocket 53 is secured to the shaft as by a pin 61 and coupled by the chain 62 to the remote actuator 17. The sprocket 53 is located abutting the microspacer ring 57 and held spaced slightly from the spacer block 54. The shaft 58 projects upwardly of the sprocket 53 through the thrust bearing assembly 21 and into an opening in a sliding transfer plate 63. The bearing housing 39 of die cut roll 3 rests on and is vertically supported by the transfer plate 63.

The bearing assembly 21 includes a ring-shaped thrust bearing 64 located between a pair of washers 65 and 66. The lower washer 65 is supported on the sprocket 53.

The transfer plate 63 rests on the upper washer 66 to transfer the die cut roll load through the adjusting unit 16 to the anvil roll bearing housing 34 and anvil roll 2 and thus to the frame through the lower anvil roller cam assembly or unit 25.

The transfer plate 63 is a flat, rigid plate spanning the slot 31 and supports the unattached underside of the housing 39 of the die roll bearing unit 15. The opposite ends of the plate 63 are notched as at 66*a* to mate with the slot edges to guide the vertical movement of the plate 63. The transfer plate 63 thus supports the die plate roll 3 on the adjusting unit 16 and the lower bearing housing 34 and cam assembly 25.

The rotation of the sprocket 53, the interconnected shaft 58 and micro ring 57 produces an axial adjustment and positioning of the shaft 58 relative to the support plate or block 54 and lower anvil bearing unit 14. The micro ring and micro nut member are formed with a fine, hardened threads. This provides means to produce relatively fine, minute adjustment of the relative spacing between the bearing housings 34 and 39. The operator can therefore accurately position the opposite ends of the die roll 3 for producing a small, precise gap 13 between the rolls 2 and 3 throughout the opposed portion, and more importantly produce a gap 13 which is precisely the same across the face of the die cutting cylinder or roll 3 and the anvil roll 2.

The operator produces the desired gap by operation of the remote actuator 17.

The remote actuator 17 includes a U-shaped support bracket 67 secured to front edge of the frame side plate as by bolts 68 to the opposite ends of the bracket. The bracket 67 opens outwardly. A sprocket 69 is rotatably mounted within the bracket 67 on a shaft 70. The coupling chain 62 connects the sprocket 69 to the sprocket 53 on the adjustment unit shaft 58, such that rotation of the sprocket 69 results in a corresponding adjustment of the roll gap 13 as discussed above.

The lower end of the shaft 70 is journaled in pilot block 71 bolted to the bottom plate of the bracket 67. The shaft 70 is coupled by a reduction unit 23 to the rotation dial 22. The upper end of the shaft is supported in a suitable bearing member 73.

The mechanical output of the reduction unit 23 is substantially less than the rotating input and preferably producing a large reduction, such as 100 to 1. The operator rotates the rotatable dial 22. Each complete revolution of the dial 22 results in a 1/100, the rotation of the shaft and attached sprocket 69. Although the reduction unit 23 may be of any suitable construction, a particularly satisfactory unit is a well known phaser/indexer manufactured and sold by the Harmonic Drive division of USM Corporation, such as a Model HDI-25, permits precise relative shaft phase adjustment between a pair of shaft members and the like. The unit is available with a large reduction ratio, and is designed to be used in production machine environment such as encountered in a die cutting line.

In summary, the anvil roll 2 and die roll 3 are assembled with the bearing units 14 and 15 for assembly within slots 31 of the frame structure 4 with the lower support units 25 in place. The top loading units 26 are attached and the rolls 2 and 3 are geared to the drive unit.

The spring washer assembly of units 26 are compressed to a preset height for producing the desired loading of the roll bearings 14–15. The load screw 42 is turned down until a selected gap is established between the guide plate 44 attached to the screw 42 and the top clamp plate or bar 46. This creates a continuous loading from the upper roll 3 through both the bearing units 14 and 15 to and through roll 2 to the lower supports 25. Thus, the clearance in the bearing does not result in relative movement of the rolls and consequently the die rolls will not bounce as a result of the pressurizing against and release of the web by the working member 6. Thus, the clearance of the bearings is removed and does not appear in the support system with the illustrated embodiment. As the gap is increased, the resulting load is increased. The spring washer assembly 49 should not be over-compressed because this would prevent movement between the die cylinder or roll 3 and the anvil cylinder or roll 2 in the presence of a product jamming condition. Further, excess load will normally produce unnecessary wear on the medium parts, as well as heating of the supporting cam rollers of the loading system. Further, whenever the loading is increased, the gap 13 decreases and must be reset to prevent possible damage from the smaller gap.

The gap adjustment unit 16 permits direct operator setting of the gap 13. The reduction or phasing unit is actuated by rotation of the dial 22 to produce a 100 to 1 change in the movement of the chain and sprocket connection and thus of the adjustment lead screw. In a practical construction, the phasing unit in combination with the lifting thread of the lead screw and follower provided an adjustment equal to 0.0001 inches of separation for each $\frac{1}{4}$ turn of the dial. This permits accurate and precise adjustment of both ends of the roll to produce a uniform gap 13 across the face of the rolls 2 and 3. In practice, initial set up should proceed with an initial adjusting of the gap to a selected minimum length or heighth as by use of a suitable feeler gauge with the roll and bearing units properly loaded by the unit 26. The adjustment unit 16 is then actuated downwardly until a proper cut is being obtained. The adjustment of the size of gap 13 is well known to be extremely significant. Thus, an unnecessarily short gap may result in less than optimum operation, such as shortened die life, working plate and/or cylinder damage, bounce in the magnetic cylinder and marking of the anvil cylinder.

The remote actuator 17 or the like is particularly desirable in connection with small cylinders or rolls where the available space prevents convenient access to the mechanism between the adjustment means between the rolls, but other systems can be provided, including direct adjustment if space is available. The structure with the gear reduction means has been found to provide a particularly satisfactory system for precise and accurate positioning of the gap. Similarly, the illustrated preload means provides a highly stable operation at high speed but other similarly functioning systems which provide the continuous preload from roll through both bearing units to the opposite roll may be provided within the teaching of this invention.

In the illustrated embodiment, the die roll 3 is thus resiliently held within the frame slot 31 and is adapted to be accurately positioned. In die cutting and similar operation precise lateral alignment of the roll 3 may also be required. The loaded mounting of roll 3 permits lateral positioning of the roll. In the illustrated embodiment a simple positioning screw unit 74 is shown in FIGS. 1 and 2 coupled to the one end of roll 3, and particularly to the gear housing or box 39. The screw unit 7 including a support plate 75 is affixed to the frame plate 27 as shown in FIG. 1 and includes a handle 76 connected to a screw 77 which threads through a coupling 78 and abutts the housing 39. Rotation of the handle 76 in one direction pulls the roll 3 toward the plate 27 while opposite rotation pushes the roll toward the opposite plate 28 and the drive side of the machine.

Although not described, the screw adjustments, such as in the side shift unit and the preload unit, are of course provided with jam or lock nuts to lock the units in the adjustment position.

Various modes in carrying out the invention are contemplated as being within the scope of the following claims, particularly pointing out and distinctly claiming the subject matter which is regarded as the invention.

I claim:

1. A rotating web processing apparatus having a pair of opposed working cylinders, at least one of which includes a web working means, comprising a support, bearing means secured to said support and to the opposite ends of said cylinders for rotatably supporting said cylinder, at least one of said bearing means at each end of said cylinders being movable to vary the spacing between the cylinders, a separate gap adjustment means located between said bearing means at each end of the cylinders and having relatively moving elements including a rotating element for separately varying the spacing of said bearing means at each end of the cylinder, and separate actuator means for each of said gap adjustment means and each including a motion reduction means having a reduction on the order of 100 to 1, said motion reduction means mounted to said support in spaced relation to said gap adjustment means and having a rotating output member spaced from the rotating element, and a transmitting member connected to said rotating output member and to said rotating element for establishing accurate and small changes in the gap adjustment means for precise location of said cylinders.

2. The apparatus of claim 1 wherein said relatively moving elements include a screw and follower assembly including a screw member secured to one of said bearing means and a follower member secured to the other of said bearing means.

3. The apparatus of claim 1 wherein said cylinders are located in vertical spaced alignment to define a top cylinder and a bottom cylinder, said support includes a guide opening for said bearing means, said gap adjustment means includes a lead screw and a lead screw follower, said follower being attached to said bearing means for the lower cylinder with a vertical axis of rotation in alignment with the axial plane of said cylinders, said lead screw being threaded into said follower and extending upwardly toward the bearing means of the top cylinder, a rotatable round member secured to the lead screw and coupled by an endless connecting band to said actuator, a thrust bearing assembly located on the round member, said bearing means of said top cylinder supported on said thrust bearing assembly, and a preload means engaging the exterior surface of said top cylinder to preload said bearing means.

4. The apparatus of claim 3 wherein said actuator includes a phasing means having said motion reduction means and having a rotating input dial and an output shaft, a round member connected to said output shaft and coupled to said endless connecting band.

5. The apparatus of claim 4 wherein said round members are sprockets and said endless band is a chain.

6. The apparatus of claim 3 wherein said lead screw includes a shaft having a lead screw ring secured to the lower end, said round member secured to the shaft and having a flat top wall, said thrust bearing assembly including a pair of washers separated by an annular thrust bearing located on the shaft and beneath the outer end of the shaft, said one washer located on said flat top wall, and a transfer plate having an opening receiving the shaft, and means connecting said transfer plate to the bearing means of the top cylinder.

7. The web processing apparatus of claim 1, including a cylinder preload means including resilient means engaging one of said cylinders and resiliently urging the cylinder in the direction of the other cylinder and thereby preload said bearing units and said adjustment means.

8. The web processing apparatus of claim 7 and having control means to adjust the level of said preload.

9. The apparatus of claim 7 wherein said cylinders are positioned in vertically spaced relation, and said preload means includes a cam roller assembly engaging the outer end surface of the top cylinder and a preload shaft member secured within a loading plate, a plurality of attachment means connected to said support and including compression spring means coupled to said plate and biasing said plate and shaft member to engage said cam roller assembly to resiliently bias said top cylinder toward the lower cylinder, and a cam roller assembly located beneath said lower cylinder.

10. A rotary die cutter apparatus comprising a frame having spaced side frame members, an anvil roll having end support shafts, a die cut roll having end support shafts, bearing housing including a journal for the corresponding shaft, each bearing housing being mounted within a vertical slot in one of said frame members, the opposed walls of adjacent bearing housings being flat walls, an adjustable mechanical spacer unit between said housing walls, said spacer unit including a lead screw and follower having a follower member fixedly attached to one of said housing and having a lead screw threaded into said follower member, a sprocket member fixed to said lead screw, a rotating thrust bearing mounted on said sprocket, said die cut roll bearing housing being supported on said thrust bearing, an actuator secured to said side frames in spaced relation to said lead screw and in alignment with said sprocket and having a sprocket aligned with and spaced from said first named sprocket, a chain means coupling the sprockets, and a reduction drive means including a rotating input dial and an output coupled to the actuator sprocket and operable to rotate the sprocket at the rate of substantially one revolution for each one hundred revolution of the input dial, preload bearing supports located one each beneath opposite ends of the anvil roll and each including a pair of cam roller engaging the outer end surface of the anvil roll, spring-loaded preload bearing unit secured one each above the opposite ends of the die cut roll and each including a pair of cam rollers mounted in a yoke and engaging the outer end surface of the die cut roll, said preload bearing units engaging said die cut roll including an adjustment screw threaded in a plate and bearing on the backside of the yoke and having a pair of backing springs urging said plate toward the die downwardly against the adjustment means and loading said die cut roll and said anvil roll against said preload bearing support beneath said anvil roll.

* * * * *